US011717740B2

(12) United States Patent
Blocker et al.

(10) Patent No.: US 11,717,740 B2
(45) Date of Patent: Aug. 8, 2023

(54) APPARATUS AND METHOD FOR MOTORIZED TRACTION DEVICE TO ASSIST ALPINE TOURING SNOW SPORT EQUIPMENT MOVEMENT

(71) Applicants: Robert Ray Blocker, Mountain Green, UT (US); Raelene Ehlers Blocker, Mountain Green, UT (US); Weston Robert Blocker, Mountain Green, UT (US); Zachary Richard Blocker, Mountain Green, UT (US); Tyler Joseph Blocker, Mountain Green, UT (US)

(72) Inventors: Robert Ray Blocker, Mountain Green, UT (US); Raelene Ehlers Blocker, Mountain Green, UT (US); Weston Robert Blocker, Mountain Green, UT (US); Zachary Richard Blocker, Mountain Green, UT (US); Tyler Joseph Blocker, Mountain Green, UT (US)

( * ) Notice: Subject to any disclaimer, the term of this patent is extended or adjusted under 35 U.S.C. 154(b) by 0 days.

(21) Appl. No.: 17/497,793

(22) Filed: Oct. 8, 2021

(65) Prior Publication Data

US 2022/0203210 A1 Jun. 30, 2022

Related U.S. Application Data

(60) Provisional application No. 63/064,307, filed on Aug. 11, 2020.

(51) Int. Cl.
*A63C 5/06* (2006.01)

(52) U.S. Cl.
CPC ..... *A63C 5/06* (2013.01); *A63C 2005/063* (2013.01); *A63C 2203/12* (2013.01); *A63C 2203/18* (2013.01); *A63C 2203/24* (2013.01)

(58) Field of Classification Search
CPC .. A63C 5/08; A63C 5/085; A63C 5/06; A63C 2005/063
See application file for complete search history.

(56) References Cited

U.S. PATENT DOCUMENTS

| | | | |
|---|---|---|---|
| 2,455,920 | A | 12/1948 | Ebbley, Jr. |
| 2,611,624 | A | 9/1952 | Gurvich |

(Continued)

FOREIGN PATENT DOCUMENTS

| | | |
|---|---|---|
| IT | 201800006186 | 11/2019 |
| WO | WO2015104663 | 7/2015 |
| WO | WO2016151318 | 9/2016 |

*Primary Examiner* — Brian L Swenson
(74) *Attorney, Agent, or Firm* — Clayton Howarth, P.C.

(57) ABSTRACT

The present disclosure comprises a novel system that attaches to skis in an alpine touring setup and provides electric, battery powered, motorized traction that assists the skier when traveling uphill or horizontal on snow. In one embodiment, the devices removably attach to the ski near the tail and have a cylindrical traction surface that sits below the ski near the tail. The traction surface is powered by an electric hub motor which engages, either with initiation of forward movement, input from sensors, or a set programmed cadence, thereby assisting the user's moving, unweighted ski forward until the completion of that step. Once arrived at the desired destination, or when downhill travel is warranted, the user removes and stores the devices from each ski and proceeds downhill.

31 Claims, 7 Drawing Sheets

(56) References Cited

U.S. PATENT DOCUMENTS

| | | | | |
|---|---|---|---|---|
| 2,625,405 | A | 1/1953 | Staff | |
| 3,148,891 | A | 9/1964 | Heuvel | |
| 3,295,860 | A | 1/1967 | Hoven | |
| 3,568,787 | A * | 3/1971 | Gremeret | A63C 5/085 180/181 |
| 3,601,421 | A | 8/1971 | Ris | |
| 3,761,106 | A | 9/1973 | Schwarz | |
| 3,804,429 | A | 4/1974 | Rovatti | |
| 3,863,943 | A | 2/1975 | Giannotti | |
| 3,863,944 | A | 2/1975 | Waddel | |
| 3,910,593 | A | 10/1975 | Schwarz | |
| 3,951,421 | A | 4/1976 | Brangenberg | |
| 3,951,425 | A | 4/1976 | Lohr | |
| 3,953,043 | A | 4/1976 | Hinterholzer | |
| RE29,366 | E | 8/1977 | Giannotti | |
| 4,106,787 | A | 8/1978 | Thon | |
| 4,108,454 | A | 8/1978 | Schwarz | |
| 4,131,291 | A | 12/1978 | Thon | |
| 4,135,729 | A | 1/1979 | Brangeberg | |
| 4,154,457 | A | 5/1979 | Auer et al. | |
| 4,168,077 | A | 9/1979 | Grass | |
| 4,174,114 | A | 11/1979 | Hinterholzer | |
| 4,189,163 | A | 2/1980 | Schweizer et al. | |
| 4,219,206 | A | 8/1980 | Kjesbo | |
| 4,304,421 | A | 12/1981 | Kuhbier | |
| 4,526,402 | A | 7/1985 | Schwarz | |
| 4,546,650 | A * | 10/1985 | Cameron | G01C 22/02 324/171 |
| 4,799,710 | A | 1/1989 | Bamett | |
| 4,837,494 | A * | 6/1989 | Maier | A43B 3/35 36/2.6 |
| 5,397,153 | A | 3/1995 | Dutaut et al. | |
| 8,991,541 | B1 * | 3/2015 | Maier | A63C 5/08 180/181 |
| 9,737,785 | B2 | 8/2017 | Burger | |
| 10,130,836 | B2 | 11/2018 | Madion | |
| 10,213,678 | B2 | 2/2019 | Mattiangeli | |
| 10,538,298 | B1 | 1/2020 | Blocker et al. | |
| 11,021,218 | B1 | 6/2021 | Blocker et al. | |
| 11,400,360 | B1 * | 8/2022 | Crockett | B62D 55/15 |
| 2002/0167136 | A1 | 11/2002 | Lehr et al. | |
| 2006/0012096 | A1 * | 1/2006 | Geldert | B60R 9/045 269/203 |
| 2009/0270001 | A1 | 10/2009 | Crispin | |
| 2011/0012335 | A1 | 1/2011 | Jones | |
| 2013/0274078 | A1 | 10/2013 | Andrews | |
| 2013/0283541 | A1 | 10/2013 | Cridlebaugh | |
| 2013/0344757 | A1 | 12/2013 | Wojcik | |
| 2016/0135554 | A1 * | 5/2016 | Green | A45B 5/00 135/66 |
| 2017/0113119 | A1 * | 4/2017 | Burger | B62D 55/075 |
| 2017/0361202 | A1 * | 12/2017 | Mattiangeli | A63C 5/08 |
| 2019/0247734 | A1 | 8/2019 | Wood | |
| 2021/0299547 | A1 * | 9/2021 | Naumov | A63C 5/085 |

* cited by examiner

APPARATUS AND METHOD FOR MOTORIZED TRACTION DEVICE TO ASSIST ALPINE TOURING SNOW SPORT EQUIPMENT MOVEMENT

CROSS-REFERENCE TO RELATED APPLICATIONS

This application claims the benefit of provisional application No. 63/064,307 for Electric Motorized Traction Device to Assist Alpine Touring Ski Movement, filed Aug. 11, 2020, which is hereby incorporated by reference herein in its entirety, including but not limited to those portions that specifically appear hereinafter, this incorporation by reference being made with the following exception: In the event that any portion of the above-referenced provisional application is inconsistent with this application, this application supersedes said above-referenced provisional application.

STATEMENT REGARDING FEDERALLY SPONSORED RESEARCH AND DEVELOPMENT

Not Applicable.

BACKGROUND

This disclosure relates to the field of snow sports and particularly to alpine touring (AT), which is a snow skiing sport where both uphill and downhill travel by the human sports participant is required. Even further, this disclosure relates to a novel electric motorized traction device that assists the user to more easily travel uphill in a wide variety of snow conditions.

Alpine touring (AT) typically uses bindings that allow a skier's boot heel to release and pivot at the toe for moments of uphill travel. The boot heel then locks down for downhill travel. In addition, traction structures must be provided on the bottom surface of the ski when making human powered uphill travel to minimize undesirable backward travel. This is achieved with either a permanent modification to the bottom ski surface as is the case with a nordic style ski or a removable material is adhered temporarily to the bottom of an alpine ski. This material, often referred to as "skins," is composed of natural or artificial animal hair that allows forward movement, but resists backward movement.

When traveling uphill, a skier employs their strength to alternate left and right forward ski movement and walk uphill. The specialized bottom ski traction structure and toe pivot with releasable heel binding allows the skier to approximate a walking motion when traveling uphill on the surface of the snow even in steep terrain. Often, to help the skier travel uphill, when traveling steep snow sections, a removable binding insert is placed between the ski and the binding such that the heel portion of the binding is raised from the ski. This provides more ski edge control and facilitates steep uphill assents.

Disadvantageously, with the present state of the art, uphill ski travel is cumbersome and laborious. The state of the art has focused on minimizing equipment weight and improve designs to make alpine touring as energy efficient as possible for the skier. Against this background, it would be desirous to provide an innovation that assists the skier in their uphill travel.

SUMMARY OF THE DISCLOSURE

The present disclosure comprises a novel set of devices that attach to a typical AT ski setup and provides motorized traction that assists the skier when traveling uphill or horizontal on snow. The device does not propel a non-active skier, but rather only assists to propel the unweighted ski forward as the skier initiates a step.

In an embodiment, the device attaches near the tail portion of each snow ski. Each device is composed of a primary housing, that rests on the top surface of the snow ski, that consists of an electronic circuit board and a removable battery. The battery and circuitry power the hub motor that is situated below the ski. The hub motor engages various cylindrical traction surfaces (depending on snow conditions) to propel the unweighted ski forward for the duration of the step. The device is firmly attached to the ski with a circumferential clamping device and an arm that connects to one side of the hub motor.

When a skier initiates forward movement of the ski, the motor engages and assists the ski forward until the completion of that step by powering the hub motor and cylindrical traction surface. The length of time the motor engages is preset by the user depending upon the stride desired. Alternatively, motor engagement and disengagement can be caused by a sensor in the toe piece or heel of the binding that communicates appropriate timing of motor engagement. A combination of these structures can also be implemented within the scope of the present disclosure. Also, the motor engagement structure can be set to a predetermined cadence and not initiated by sensing a step of the skier.

The device on each ski, including the housing, clamping system, and hub motor with the cylindrical traction surface, would be completely removed from the skis for downhill travel.

BRIEF DESCRIPTION OF THE DRAWINGS

Some embodiments of the present disclosure are illustrated as examples and the scope of the present disclosure is not limited by the figures in the accompanying drawings, in which like references may indicate similar elements and in which.

DETAILED DESCRIPTION

Figure 1:
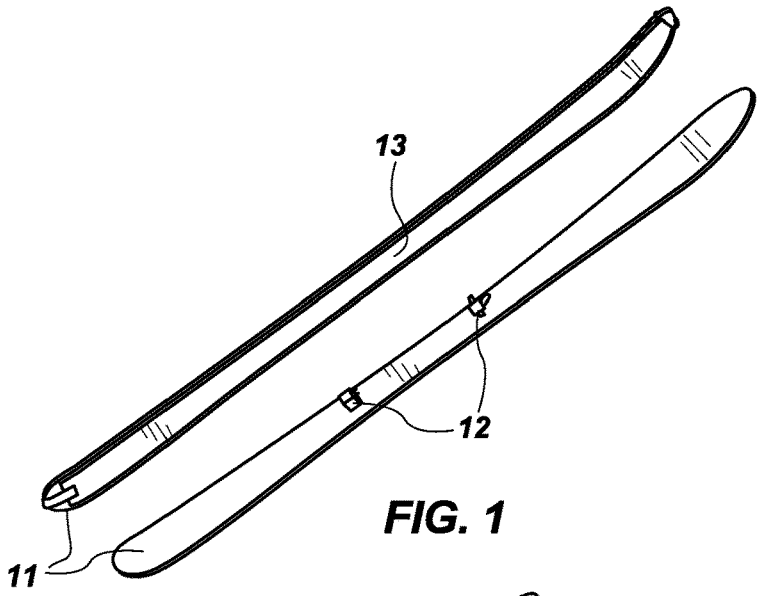
FIG. 1 is a diagrammatic representation of a standard alpine touring (AT) ski setup.

For the purposes of promoting an understanding of the principles in accordance with this disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the devices, systems, processes and methods will be disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular illustrative embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a", "an", and "the" include plural referents unless the context clearly dictates otherwise.

As used herein, the terms "comprising," "including," "containing," "characterized by," "having" and grammatical equivalents thereof are inclusive or open-ended terms that do not exclude additional, unrecited elements or method steps.

For convenience in describing the method and use of the current disclosure, singular masculine or feminine pronouns have been used to describe the person executing the methods described. It is to be understood that no limitation of the invention to use by one gender or the other is intended by such use.

In describing the embodiments of this disclosure, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps or applications in an unnecessary fashion. Nevertheless, the specification and claims should be read with the understanding that such combinations are entirely within the scope of the claims.

New devices, apparatus, and methods for assisting a skier, or snowboarder, as they travel uphill with a standard AT setup are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as only exemplary and is not intended to be limiting to the specific embodiments illustrated by the figures or description herein. One of the illustrated embodiments comprises a motorized drive element, a motor, means for securing the motorized drive element and motor to a snow sport device; a snow sport device being a ski or split snowboard appropriate for alpine touring. It is to be understood that a reference to a "ski" in this disclosure may encompass a split snowboard or other snow sport device appropriate for alpine touring as well as any device consisting of one or more runners which are intended to glide over a soft or pliable surface. The device also comprises means for engaging the motor only when the ski is moved forward, as when the user is taking a forward step. In alpine touring, when moving uphill or across level ground, the ski is moved forward much as in walking, so throughout the process weight is removed from each ski alternately as the user propels his/her body forward, and the means for engaging the motor only when the ski is moved forward may comprise a sensor that determines when weight has been removed from the ski. One of the embodiments described herein applies a forward thrust from the motor to the ski through the drive element when the ski is moved forward, thus assisting the user each time the ski is moved forward and reducing the energy a user must expend with each "stride" of the skis and improving a skier's endurance.

The present invention will now be described by referencing the appended figures representing illustrative embodiments. FIG. 1 depicts one example of a standard alpine touring (AT) ski setup without any novel modifications displayed to show a standard form. The term AT ski setup, as used herein, generally refers to ski, or a snowboard split board, that allows the user to uphill travel on a snow type surface under their own power. An AT ski (or split board) setup generally comprises two skis 11 of different possible widths, shapes and lengths; two AT bindings 12 mounted in standard fashion, wherein said AT bindings allow the toe of the user's boot to pivot while the heel detaches from the binding while touring and the heel locks in place when skiing downhill and skins 13 that attach to the bottom surface of each ski (or split board) 11 that allow forward motion, but restrict backward motion.

Figure 2:
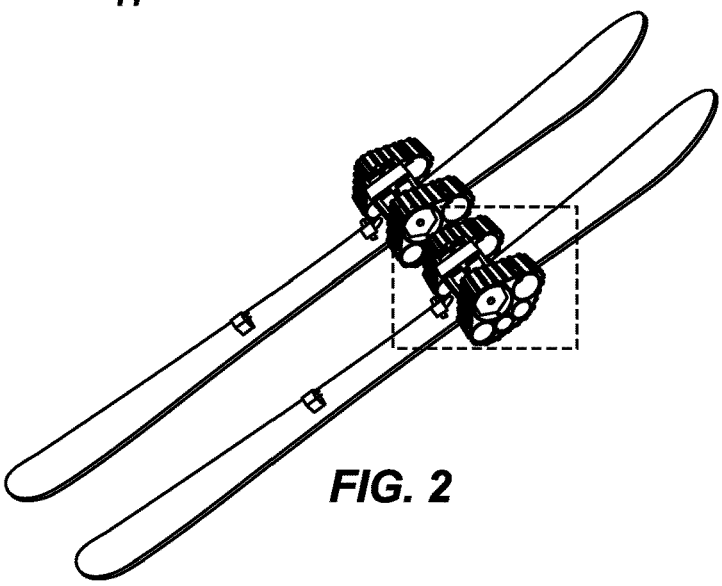
FIG. 2 is a perceptive view of skis to which one illustrative embodiment of an electric motorized traction device has been installed.
Figure 2A:
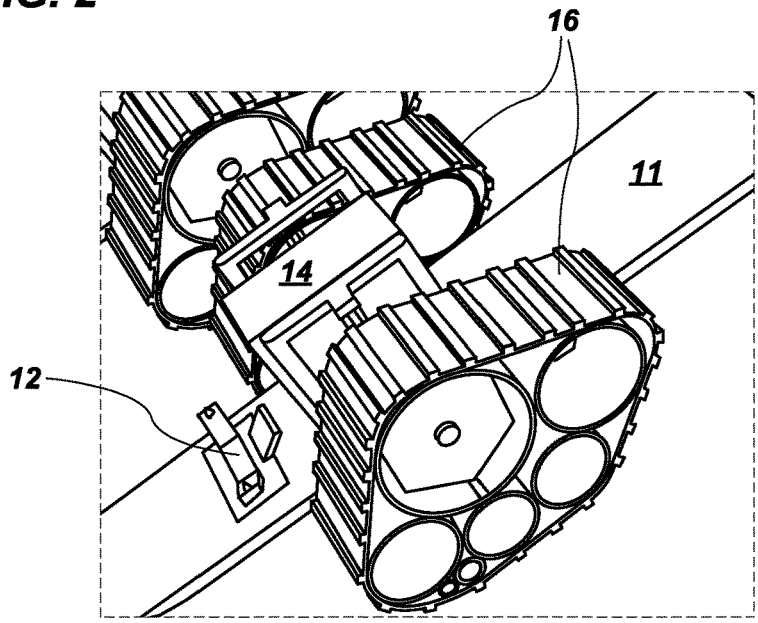
FIG. 2A is a detailed view of a portion of the illustrative embodiment represented in FIG. 2.

FIGS. 2 and 2A depict one illustrative embodiment of an electric motorized traction device which may be installed on a ski in an embodiment of the instant disclosure. In one embodiment one device may be installed on each ski. Each device comprises: a housing 14 large enough to contain an electric motor, gear box differential, and a battery pack (which may or may not be removable); and drive element 16, which in one embodiment comprises a pair of traction belts, one located on either side of the ski. Each traction belt has sufficient tread width, length, and texture to provide traction on a variety of snow conditions. In one embodiment, the device may be attached to the ski 11 just in front of the binding 12. In another embodiment, the device may attach to the ski in any position according to the snow conditions.

Figure 3:
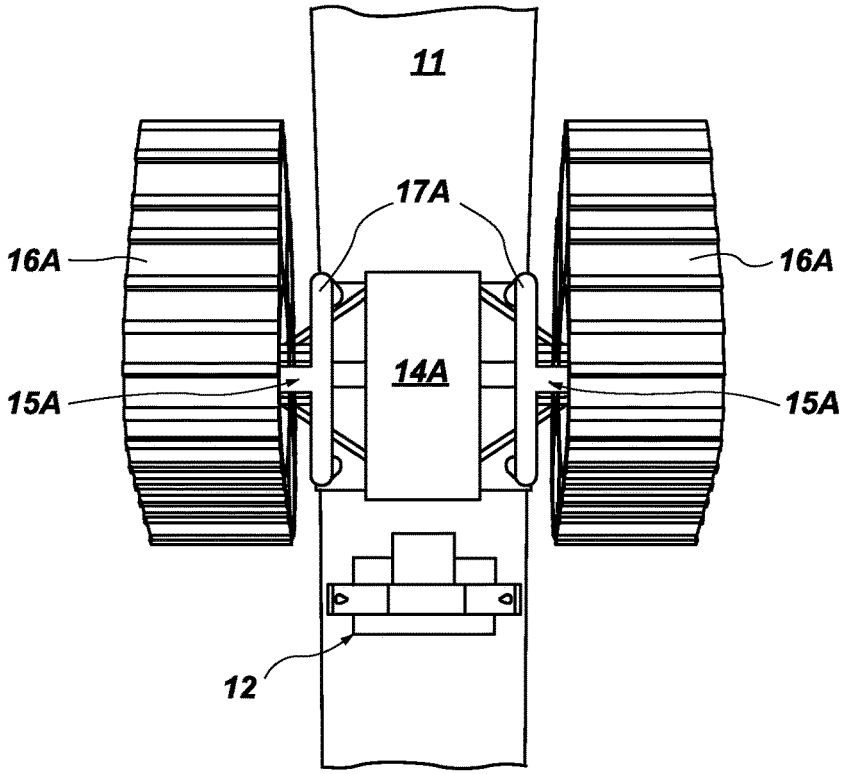
FIG. 3 depicts one embodiment of an electric motorized traction device installed on a ski just in front of the binding, as seen from above.
Figure 4:
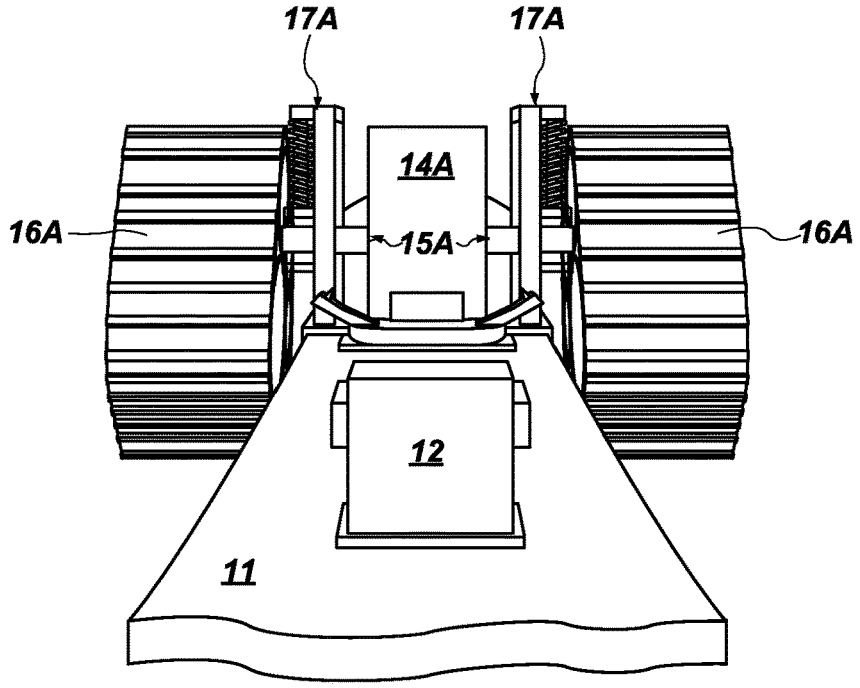
FIG. 4 depicts the same embodiment of the electric motorized traction device as seen in FIG. 3, from the back of the ski.

FIG. 3 depicts another illustrative embodiment of an electric motorized traction device installed on a ski 11 just in front of the binding 12, as seen from above. FIG. 4 depicts the same embodiment of the electric motorized traction device as seen from the back of the ski. The device comprises a middle housing 14A large enough to contain an electric motor, gear box differential, and a battery pack (which may optionally be removable by the user). The device also comprises two traction belts 16A which serve as a drive element, each having sufficient tread width, length, and texture to provide traction on most snow conditions. Dual drive shafts 15A extend laterally on each side of housing 14A and connect the middle housing 14A containing the motor with the two traction belts 16A, powering the traction belts 16A. The traction belts 16A attach longitudinally relative to the inside and outside edge of the ski 11 via the dual drive shaft 15A and the suspension system 17A. The housing 14A and suspension system 17A are attached to the ski 11 in such a way as to be stable and secure yet easily removable without causing damage to the ski 11. The suspension system 17A is designed to optimize the contact of the traction belts 16A with the snow surface.

To use the device, the user installs the housing 14A with the attached drive shafts 15A, suspension systems 17A, and traction belts 16A onto each ski (or split board) 11 that is set up for alpine touring. When the user initiates forward movement of the ski (or split board) 11, the motor engages and assists the ski 11 forward by powering the traction belts 16. The length of time the motor engages is may be preset by the user depending upon the stride desired. Alternatively, motor engagement and disengagement could be as the result of a sensor in the toe piece or heel of the binding 12 that communicates appropriate timing of motor engagement. A combination of these two methods could be used as well.

In one illustrative embodiment, there is a sensor located in the suspension system 17A, which senses when the user takes weight off the ski (so as to move the ski forward), and engages the motor. When the user places weight on the ski again, the sensor in the suspension system 17A causes the motor to disengage. In another embodiment, there is a sensor located in the binding 12 which determines when the user is taking a step forward and engages the motor. In yet a yet another embodiment, a circuit board may be located in the housing 14A and programmed to engage the motor at regular intervals, set to the user's stride.

Once the user reaches their desired location and/or downhill travel is desired, the device on each ski (or split board) 11, including housing 14A and two traction belts 16A, are removed and stored in a backpack or otherwise.

Preferred materials for the device are metal, metal alloys or hard plastics for the structures and mechanisms, and a rubber like material for the tractor belts. While preferred materials for the device have been described, the device is not limited by these materials. Wood, plastics, foam, rubber, fiberglass, metal alloys, carbon fiber, aluminum, vinyl, various fabrics, sand and other material may comprise some or all of the elements of the electric motorized traction devices and apparatuses in various embodiments of the present disclosure.

Figure 5A:
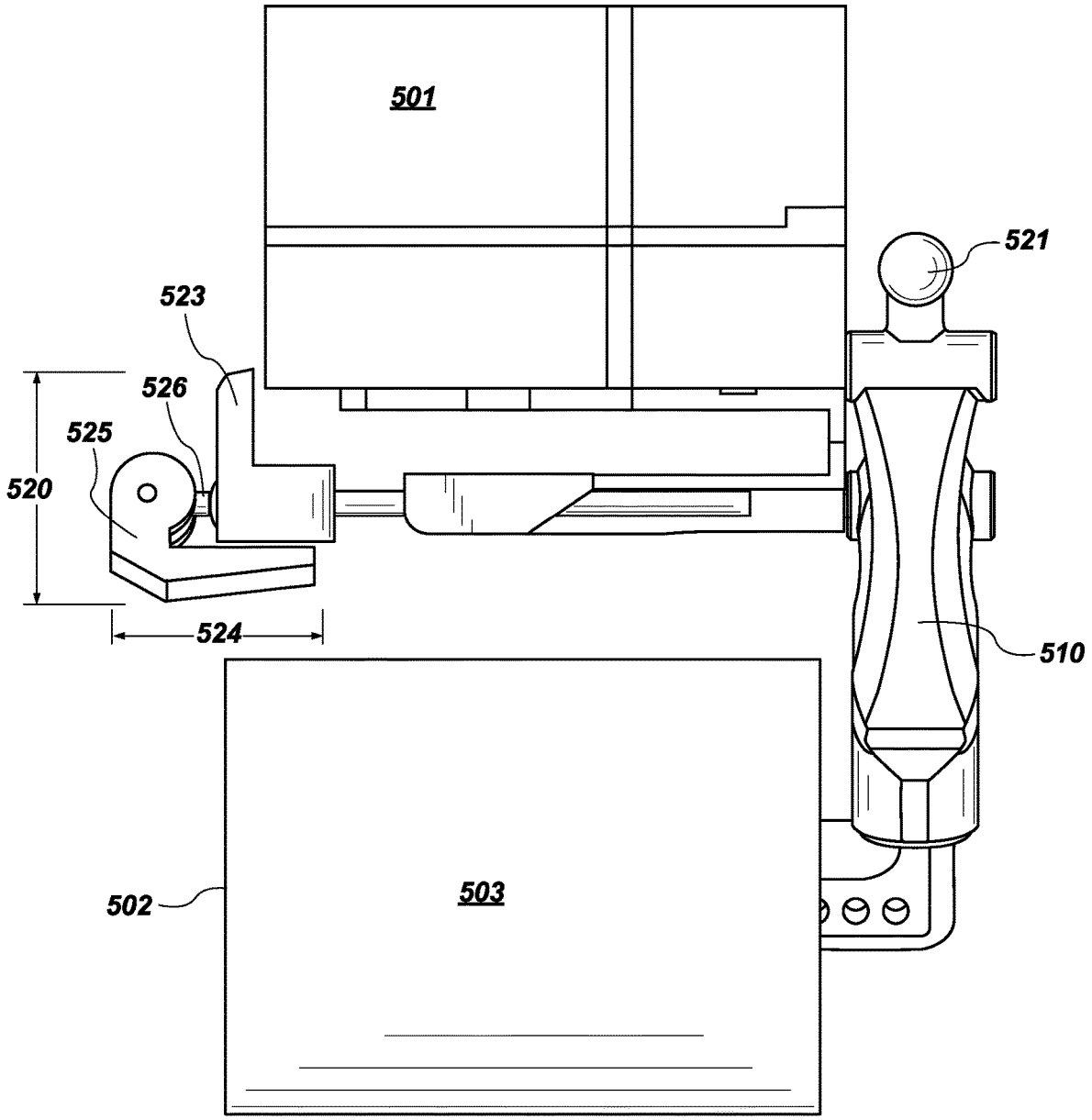
FIG. 5A depicts another embodiment of an electric motorized traction device to assist alpine touring ski movement which comprises a device which can be fit to each ski and showing the device from the rear.
Figure 5B:
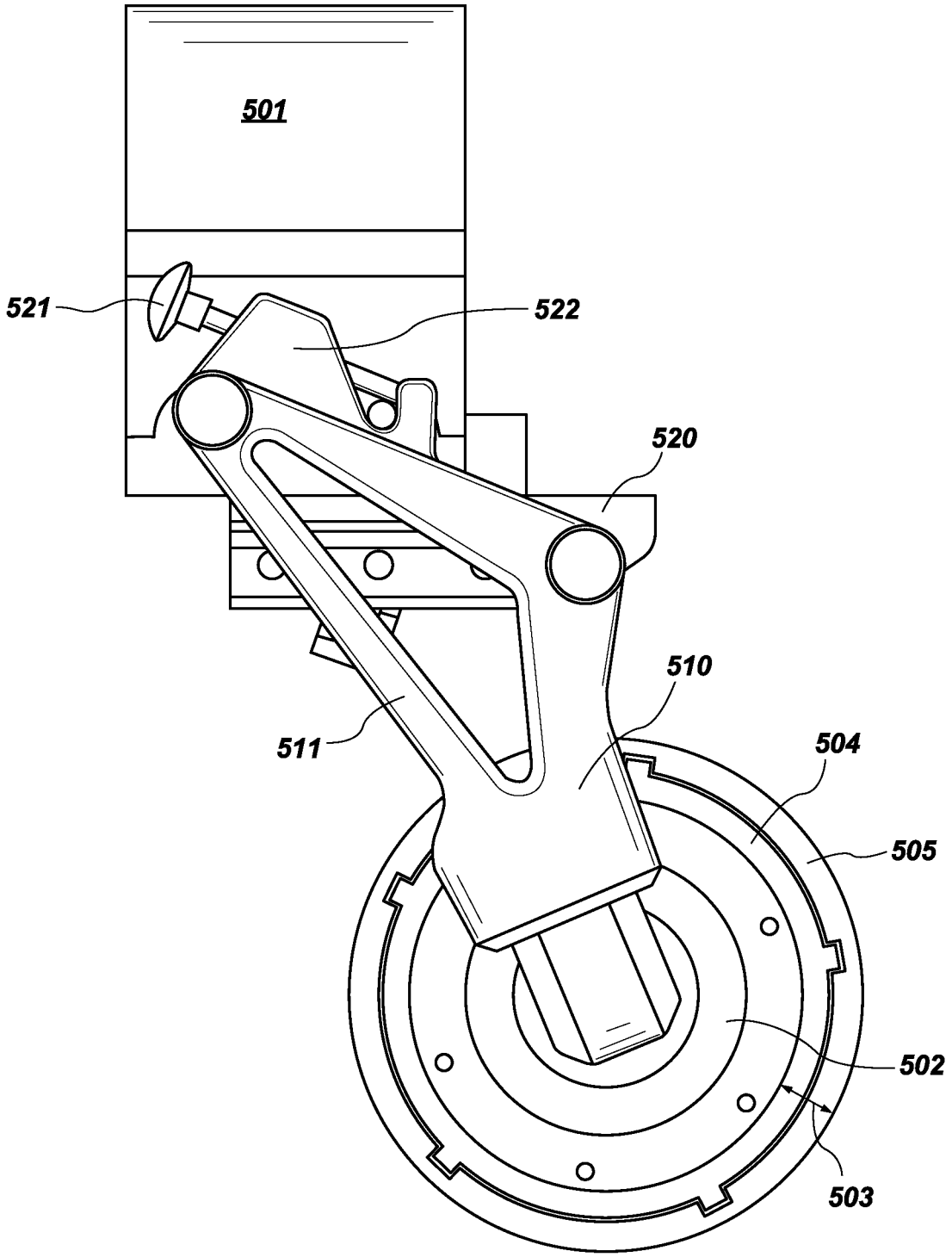
FIG. 5B shows the embodiment of FIG. 5A from the support arm side.
Figure 5C:
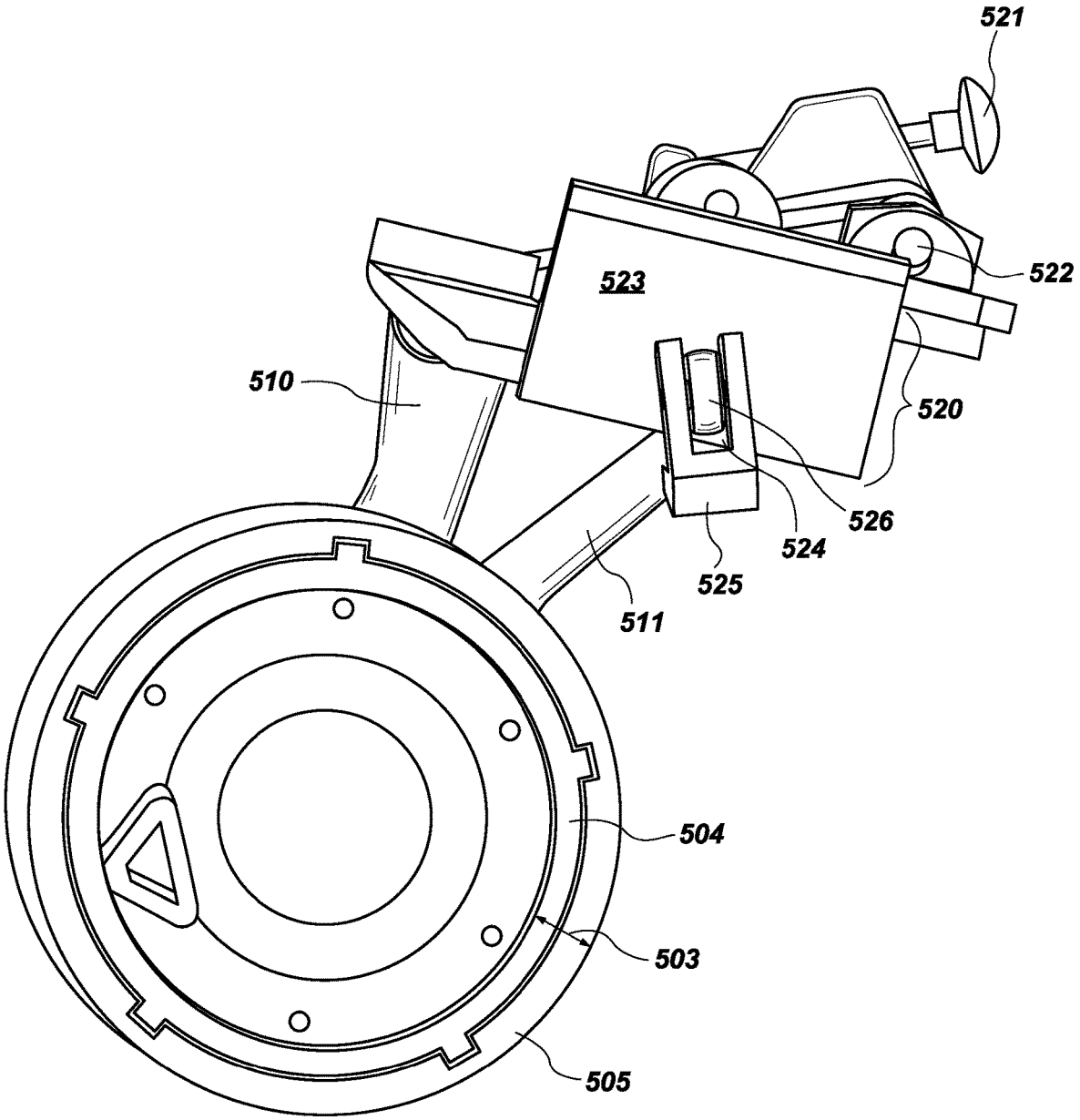
FIG. 5C shows the embodiment of FIG. 5B from the opposite side of FIG. 5B without the primary housing.

Another embodiment of an electric motorized traction device to assist alpine touring ski movement, which is illustrated in FIG. 5A-C, comprises a device which can be fit to each ski. FIG. 5A shows the device from the rear. FIG. 5B shows one embodiment of an electric motorized traction device from support arm side. FIG. 5C shows one embodiment of the instant disclosure from the non support arm side without the primary housing 501. Each device is composed of a primary housing 501 that rests on the top surface of the snow ski. The primary housing 501 may contain an electronic circuit board and a removable battery (not explicitly shown). The primary housing 501 may completely surround the electronic circuit board and removable battery, thus protecting them from the elements. The battery and circuitry in the primary housing 501 power and control the hub motor 502 that is situated below the ski. In one embodiment, the hub motor 502 may engage a drive element which in one embodiment may comprise a cylindrical traction surface 503.

The cylindrical traction surface 503, in FIGS. 5A-C, may comprise one of a number of cylinders with different surfaces, depending on snow conditions. The cylindrical traction surface may be activated for just enough time to propel the unweighted ski forward for the duration of the step. In one embodiment, the cylindrical traction surface 503 may comprise a tread sleeve 504 and one of multiple tread sleeve covers 504 which may be attached to the surface of the tread sleeve so as to provide an appropriate traction surface for a variety of conditions. In another embodiment, the cylindrical traction surface itself 503 may be removable and may be easily interchanged with another cylinder having a different surface, with each surface being appropriate for different conditions.

In one embodiment, the hub motor 502 is attached to the main housing 501 by a support element 510. In one embodiment, the support element 510 is a tri-arm connector, having three portions. The tri-arm connector may also comprise a spring suspension system 511, embedded within the tri-arm connector 510. In one embodiment, this spring suspension system 511 may also comprise an electronic sensor which communicates with the electronic circuit board in the main housing 501. The sensor in the spring suspension system 511 may cause the electronic motor 502 to engage when the sensor detects that weight is not on the ski. In another embodiment, there may be a sensor in the binding of the ski (11 in FIG. 1) connected to the electronic motor 502, which causes the electronic motor 502 to engage when the sensor detects that the weight is not on the ski. In one embodiment the main housing 501 may contain a circuit board which receives signals from a sensor and controls the motor 502.

In one embodiment, there may be no sensor which signals the motor. In this embodiment, the circuit board may be programmed to engage the motor in a specific sequence, with timing set to match the stride of the user, in a cadence. In yet another embodiment, there may be a sensor in the motor or on the drive element which detects when a user begins to move the ski forward and engages the motor to assist in that forward movement. In another embodiment, the sensor may determine when the ski is about to move forward by sensing when the user's weight is removed from the ski, as when the user lifts weight off the ski to move it forward.

It will be appreciated that all of the structures depicted herein, and particularly those represented in FIG. 5A-C, are intended to function as a means for engaging the motor when weight is removed from the snow sport device and any structure, device, system, or apparatus which performs the same or equivalent functions as the means for engaging the motor when weight is removed from the snow sport device are intended to fall within the scope of the means for engaging the motor when weight is removed from the snow sport device.

In one embodiment, still referring to FIGS. 5A-C, the device may also comprise a circumferential clamping device 520 (encompassed by the bracket at 520 in FIG. 5A), which is attached to the tri-arm 510 between the hub motor 502 and the main housing 501. The hub clamping device 520 may comprise any means which will secure the device to the ski. In one embodiment, the device is secured to the ski at the very back of the ski. In another embodiment, the device is secured to the ski at the rear of the binding. In one embodiment, the hub clamping device 520 may comprise a sliding pin 521 and secondary pin 522 on the side of the device comprising the connection between the main housing 501 and the electronic motor 502. In one embodiment, the sliding pin 521 is spring loaded, and when it is pulled out it allows the secondary pin 522 to slide underneath it. The secondary pin 522 may also be spring loaded. Then the sliding pin 521 is released, allowing it to retract over the secondary pin 522 locking it into position. In one embodiment, the other side of the device comprises a second complementary means for securing the device to the ski and it is to be understood that any structure, system, device or apparatus which performs the same function as the structures represented herein are intended to fall within the secondary complementary means. In one embodiment, the second means for securing the device may be a clamp 523 attached to securing element 524 and it is to be understood that any structure, system, device or apparatus which performs the same or equivalent function as the second means for securing the device is intended to fall within the scope of the secondary complementary means. In one embodiment, the securing element 524 may be similar to a cam, comprising a lever 525 and a tightening rod 526 secured to the lever in such a way that moving the lever will push the clamp into position and secure the device tightly to the ski.

It will be appreciated that all of the structures depicted herein, and particularly those represented in FIG. 5A-C, are intended to function as a means for removably attaching the apparatus to a snow sport device and any structure, device, system, or apparatus which performs the same or equivalent functions as the means for removably attaching the apparatus are intended to fall within the scope of the means for removably attaching the apparatus.

In one embodiment of the system, the user attaches the device to the ski in a location between the back of the binding and the tail of the ski, securing the device with a combination of the sliding pin 521 and clamp 523. In one embodiment the device may be attached in a variety of positions behind the binding depending upon the conditions. For example, softer snow would require additional traction, so the user would want to attach the device closer to the binding, so that more weight would be on the device. When traveling on more compact snow, however, the device would be attached closer to the tail of the ski. When the user is traveling on level ground or uphill and the user initiates forward movement of the ski, the motor 502 engages and turns the cylindrical traction surface 503, thus propelling the ski forward and assisting the forward motion of the ski until the completion of the step. Upon completion of the step, the motor disengages. In one embodiment, the electronic circuit board may engage the motor when the sensor in the spring suspension system 511 senses that weight is not being placed on the ski, as when the ski is being moved forwarded in a step, unweighted. The motor may remain engaged for as long as no weight is placed on the ski. In another embodiment, the length of time the motor 502 engages may be preset by the user depending upon the stride desired. Alternatively, motor engagement and disengagement could be as the result of a sensor in the toe piece or heel of the binding that communicates appropriate timing of motor engagement to the electronic circuit board in the main housing. A sensor in the binding may determine when weight is being placed on the binding. Alternatively, a sensor located in the binding may determine when the foot moves in a manner so as to move the ski forward, rather than sensing weight specifically.

It will be understood that a number of different types of sensors could determine appropriate timing for activating the motor on the ski, and the setting forth of specific types of sensors is not meant to limit the instant disclosure. Alternatively, a combination of these methods and structures could be used as well. In yet another embodiment, the motor engagement could be set to a cadence, engaging at set intervals for a set period of time, and not initiated by a step at all. In such embodiment, the cadence is preferably set to match the stride and pace of the skier to the closest degree possible.

In one embodiment the device may be powered by a battery located within the main housing 501. The battery may be removable from the device. In another embodiment, the battery may be rechargeable. Again, the battery may be removable from the device in one embodiment, while yet another embodiment may have the battery permanently secured within the device. In yet another embodiment, the battery may be recharged by solar power. The device itself may comprise a solar panel and charging system in one embodiment, while in another embodiment, a separate solar-powered charging system may be plugged into the device, or the battery may be removed and placed into a separate solar-powered charging system.

In one embodiment, the motor is controlled by a circuit board located in the main housing 501, which contains software that controls the amount of time which the motor engages for when it is engaged. The software may also control the speed at which the motor engages. In one embodiment, the speed and length of time which the ski engages can be easily controlled by the user by adjusting the software. In one embodiment there may be a user interface located on the main housing. In another embodiment, the circuit board may also contain a communication device that allows it to easily communicate with an external control device. The communication device may be a wireless communication device that uses an appropriate wireless protocol, for example, Bluetooth or Wifi. In one embodiment the external control device may comprise a smartphone. In another embodiment, the external control device may comprise a dedicated controller, from which the user can adjust the settings of the motor. These settings may include but are not limited to the period of time that the motor engages for with each step and the speed of the motor. In one embodiment the device also comprises a safety to prevent the device from being activated unless the user is on the ski. This safety may take the form of a program which prevents the devices from being turned on unless both sensors in the devices attached to the ski are weighted.

Figure 6:
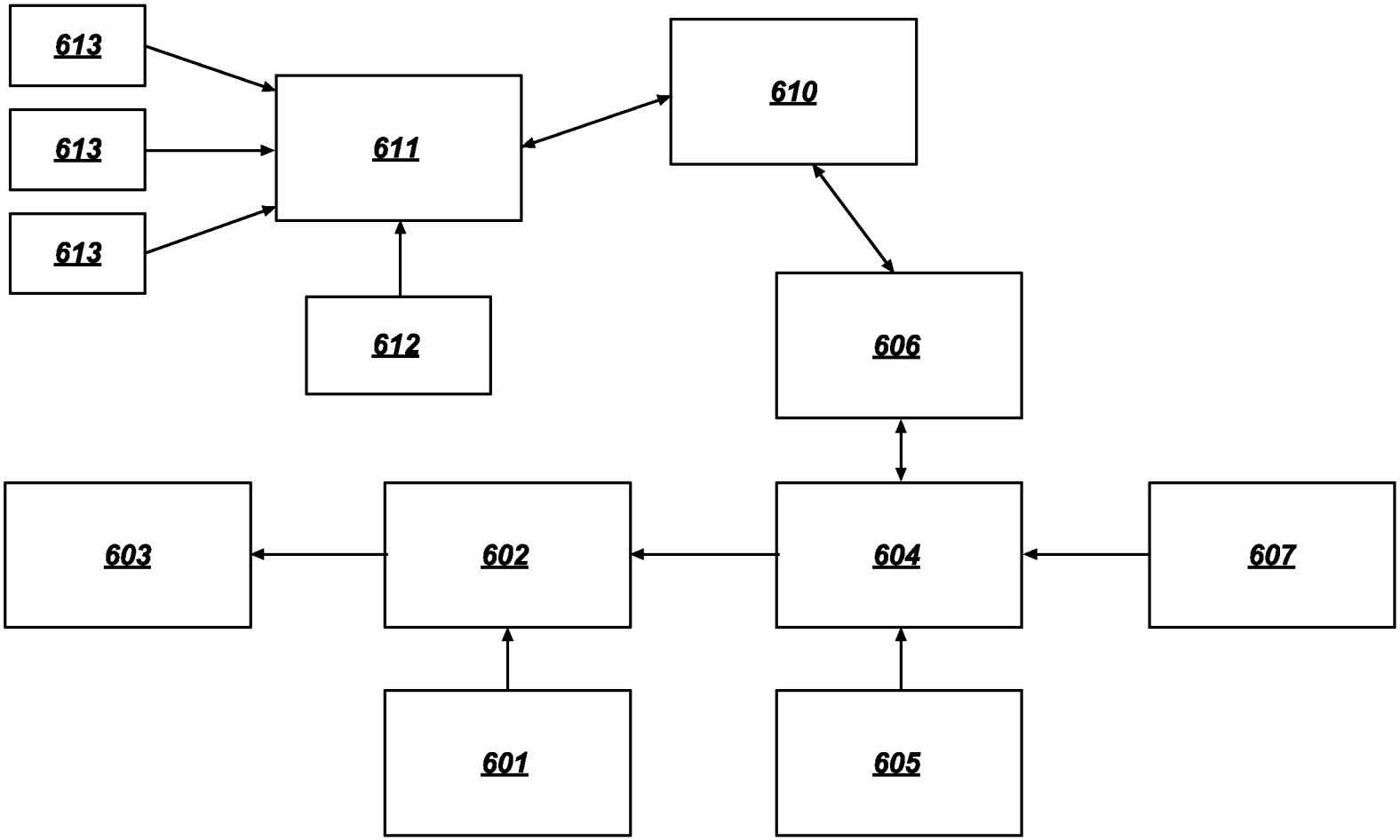
FIG. 6 shows a block diagram of the operation of one embodiment of an apparatus and method for a motorized traction device to assist alpine touring snow sport equipment movement.

A block diagram of the operation of one embodiment a method and apparatus for assisting alpine touring ski movement is shown in FIG. 6. In one embodiment, power to the on-ski apparatus is supplied by a battery 601 with suitable voltage, capacity, and discharge for the motor driver, motor, and application. This electrical power is supplied to the motor driver 602 via a connection port that the removable battery can dock to. The connection port is wired to the motor driver itself with wires of appropriate gauge. The motor driver 602 is programmed to deliver electrical power at a specified voltage and amperage to the motor 603 based on a PWM signal from the on-ski micro-controller 604. The motor driver 602 also delivers an appropriate amount of electrical power to the on-ski micro-controller 604. The on-ski micro-controller 604 receives input from an on/off switch 607, pressure sensor 605, and an on-ski receiver/transmitter 606. The input from the pressure sensor 605 (which is located on the on-ski apparatus and is oriented in such a way that it can sense if the user is putting significant weight on the ski) is incorporated in the code of the micro-controller 604 in such a way that if the pressure sensor 605 is sensing significant weight and then that weight is taken off, the motor is initiated.

Still referring to FIG. 6, the on-ski receiver/transmitter 606 provides the micro-controller with various information (described below) and is programmed to respond appropriately to such information by changing the PWM signal sent to the motor driver 602. The on-ski receiver/transmitter 606 communicates with an off-ski (or perhaps on-ski pole) receiver/transmitter 610 which is connected to an off-ski micro-controller 611. The on-ski receiver/transmitter 606 may communicate with the off-ski receiver/transmitter 610 through a Bluetooth or wireless connection. This off-ski micro-controller 611 is powered by a small battery 612 of appropriate voltage, capacity, and discharge. The off-ski micro-controller is wired to multiple inputs 613 that provide the user with the ability to turn the on-ski apparatus 611 on or off and change the output of the motor 603 in some way. Such changes may include, but are not limited to: the stride length (or duration) of the output of the motor, the speed at which the motor completes a stride length, and the minimum or maximum amperage the motor may be given.

Figure 7A:
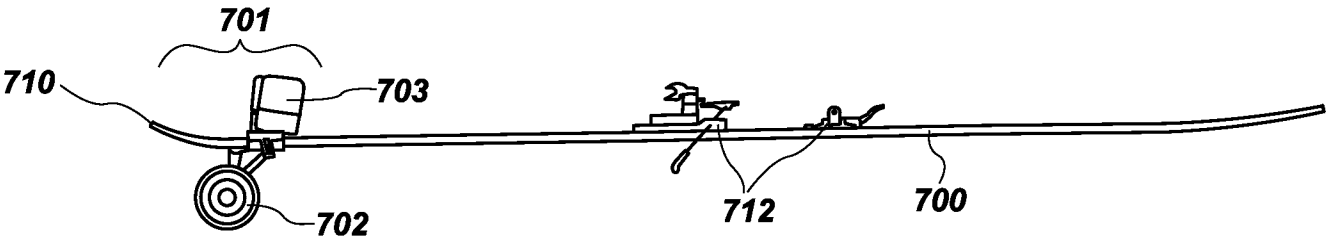
FIG. 7A shows an embodiment of an electric motorized traction device to assist alpine touring ski movement secured to a ski as seen from the side.
Figure 7B:
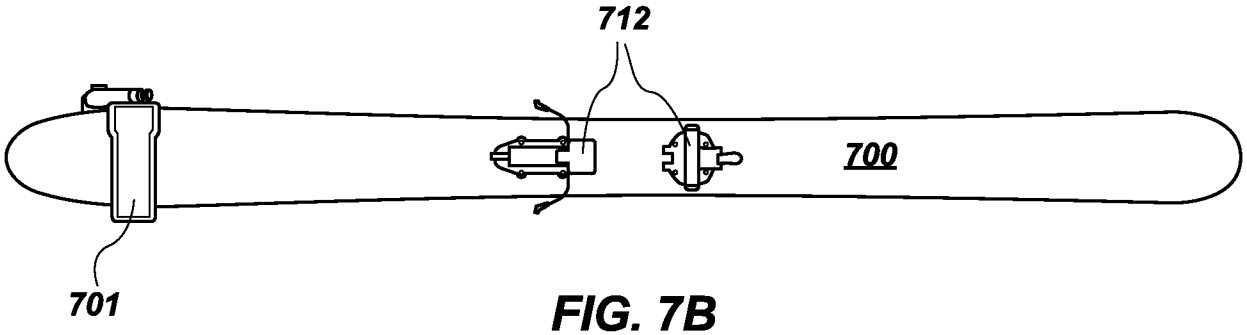
FIG. 7B shows an embodiment of an electric motorized traction device to assist alpine touring ski movement secured to a ski as seen from above.

As shown in FIGS. 7A and 7B, one embodiment of a method for assisting the forward motion of a snow sport device in alpine touring movement comprises securing a device 701 as shown in FIG. 5 to a snow sport device 700. FIG. 7A shows the ski and device from the side, while FIG. 7B shows the ski and device from the top. The snow sport device 700 may be an alpine touring ski or a split snowboard, or another device that the user propels in the same method as in alpine touring. The device comprises at least a motor and cylindrical drive element 702, which are located below the ski 700 when the device 701 is secured to the ski 700. The device 701 may also comprise a housing 703 located above the ski, which may contain a battery and a circuit board. The device may be located near the tail 710 of the ski, significantly behind the binding 712 in one embodiment. In another embodiment, the device may be moved closer to the binding, depending on the conditions. The method also comprises activating the motor when the user moves the ski forward. The motor then turns the drive element, assisting the user in moving the snow sport device forward.

The device on each ski, including the housing, clamping system, and hub motor with the cylindrical traction surface, is designed to be easily removable so that the device can be completely removed for downhill travel.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An apparatus for assisting alpine touring ski movement, comprising;

a housing;

a clamping system to attach the apparatus to a snow sport device;

a motor;

a traction surface; and a suspension system, wherein the motor drives the traction surface, causing the traction surface to move the snow sport device forward when a user moves the snow sport device;

wherein the suspension system also comprises a sensor which can determine when weight is lifted off the snow sport device to move the snow sport device forward, wherein the sensor activates the motor.

2. The apparatus of claim 1 wherein the suspension system keeps the traction surface in contact with the snow to provide better traction in a variety of conditions.

3. The apparatus of claim 1 also comprising a sensor connected to the motor, wherein the sensor determines when weight is lifted off the ski and engages the motor.

4. The apparatus of claim 3 wherein the sensor is located in the binding of the ski and is connected to the motor from the binding.

5. The apparatus of claim 1 wherein the traction surface comprises one or more traction belts.

6. The apparatus of claim 5 wherein the traction surface comprises at least two traction belts located on either side of the ski.

7. The apparatus of claim 1 also comprising a circuit board located in the housing, wherein the circuit board controls the motor.

8. The apparatus of claim 7 wherein the circuit board receives signals from a sensor and activates the motor when it determines that the snow sport device is being moved forward.

9. The apparatus of claim 8 wherein the sensor determines the amount of weight on the snow sport device and the circuit board determines when weight is lifted off the sensor to move the snow sport device forward and engages the motor.

10. The apparatus of claim 8 wherein the circuit board deactivates the motor when weight is returned to the sensor.

11. The apparatus of claim 8 wherein the circuit board deactivates the motor after a preset period of time has passed from weight being lifted off the sensor.

12. An apparatus to assist in alpine touring ski movement using a snow sport device, comprising;

a motor;

a drive element which is powered by the motor;

a means for removably attaching the apparatus to a snow sport device;

a means for engaging the motor when weight is removed from the snow sport device;

wherein the drive element comprises a cylindrical traction surface; wherein the cylindrical traction surface also comprises an interchangeable outer traction surface, wherein different surfaces suitable to different conditions can be connected to the apparatus.

13. The apparatus of claim 12 wherein the motor is a hub motor.

14. The apparatus of claim 12 wherein the cylindrical traction surface is interchangeable.

15. The apparatus of claim 12 wherein the means for removably attaching the apparatus to a snow sport device comprises a clamp and spring loaded sliding pin.

16. The apparatus of claim 12 wherein the means for engaging the motor when weight is removed from the snow sport device comprises a circuit board connected to a sensor; wherein the sensor detects the weight on the ski and sends a signal to the circuit board, which determines when weight is removed from the snow sport device and activates the motor.

17. The apparatus of claim 16 wherein the sensor is located within a spring suspension system and determines the weight present on the spring suspension system.

18. The apparatus of claim 17 wherein the spring suspension system is located in a support element between the means for removably attaching the apparatus to a snow sport device and the drive motor.

19. The apparatus of claim 16 wherein the sensor is located in the binding of the snow sport device.

20. The apparatus of claim 12 wherein the means for engaging the motor when weight is removed from the snow sport device comprises an electronic circuit board which engages the motor in timed intervals which are preselected to match the user's stride.

21. The apparatus of claim 12 also comprising means for controlling the amount of time for which the motor engages and the speed of the motor.

22. The apparatus of claim 21 wherein the means for controlling the amount of time for which the motor engages and the speed of the motor comprises:

an electronic circuit board located in a housing on top of the device which contains software that controls the motor;

a wireless communication device in the housing;

a separate wireless controller which communicates wirelessly with the wireless communication device in the housing and can be used to set the amount of time the motor engages for and the speed of the motor.

23. A method of assisting the forward motion of a snow sport device in alpine touring movement, comprising;

securing a motor and drive element to snow sport device;

securing a traction surface to the drive element;

powering the drive element with the motor upon the user moving the ski forward;

deactivating the motor after a preset period of time;

setting the preset period of time using a wireless controller, wherein the wireless controller communicates with a wireless communication device located in a housing connected to the motor and drive element secured to the snow sport device.

24. The method of claim 23 also comprising providing a sensor which determines when the user moves the snow sport device forward.

25. The method of claim 24 wherein the sensor provided is within a suspension system and determines when the user moves the snow sport device forward by determining when weight is removed from the snow sport device.

26. The method of claim 24 wherein the sensor provided is located on a binding connecting the user's boot to the snow sport device and determines when weight is removed from the snow sport device.

27. The method of claim 24 wherein the sensor provided is located on a binding connecting the user's boot to the snow sport device and determines when the user moves her/his foot in a manner consistent with taking a forward step.

28. The method of claim 23 also comprising setting the speed of the motor using the wireless controller.

29. The method of claim 23 wherein the motor is a hub motor.

30. The method of claim 23 also comprising deactivating the motor when the user places weight on the ski.

31. The method of claim 23 wherein the motor is activated at preset intervals for preset periods of time appropriate for the user's desired stride and pace.

* * * * *